United States Patent [19]

Cerceau

[11] Patent Number: 5,002,828

[45] Date of Patent: Mar. 26, 1991

[54] COMPOSITE DIAMOND ABRASIVE, PROCESS FOR PREPARATION, AND DRILLING OR MACHINING WHICH ARE EQUIPPED WITH IT

[75] Inventor: Jean-Michel Cerceau, Seyssinet, France

[73] Assignee: Societe Industrielle de Combustible Nucleaire, Annecy, France

[21] Appl. No.: 272,163

[22] Filed: Nov. 16, 1988

[30] Foreign Application Priority Data

Nov. 17, 1987 [FR] France ..... 87 16140

[51] Int. Cl.[5] ..... B32B 15/04; B32B 9/00; B24B 3/00; B24D 3/00

[52] U.S. Cl. ..... 428/408; 428/698; 428/932; 428/627; 51/293; 51/309; 76/DIG. 12; 407/119

[58] Field of Search ..... 428/408, 697, 698, 699, 428/539.5, 932, 621, 627, 634, 545; 51/307, 309, 293; 76/DIG. 12; 407/119

[56] References Cited

U.S. PATENT DOCUMENTS

| | | | |
|---|---|---|---|
| 3,745,623 | 7/1973 | Wentorf, Jr. et al. | 407/119 |
| 3,912,500 | 10/1975 | Vereschagin et al. | 75/201 |
| 4,224,380 | 9/1980 | Bovenkerk | 428/545 |
| 4,259,090 | 3/1981 | Bovenkerk | 51/309 |
| 4,311,490 | 1/1982 | Bovenkerk | 51/307 |
| 4,370,149 | 1/1983 | Hara | 51/309 |
| 4,505,746 | 3/1985 | Sumitomo | 75/243 |
| 4,798,026 | 9/1989 | Cerceau | 51/204 |
| 4,824,442 | 4/1989 | Cerceau | 51/293 |
| 4,875,907 | 10/1989 | Phaal et al. | 51/293 |

FOREIGN PATENT DOCUMENTS

| | | |
|---|---|---|
| 1349385 | 4/1975 | United Kingdom . |
| 1489130 | 10/1977 | United Kingdom . |

*Primary Examiner*—Merrell C. Cashion, Jr.
*Assistant Examiner*—Amy Hulina
*Attorney, Agent, or Firm*—Browdy & Neimark

[57] ABSTRACT

An abrasive is provided having an active phase comprising a sintered product comprising diamond grains, each grain being linked directly to its neighbors by bridging to exhibit a polycrystalline structure, and a support consisting essentially of tungsten carbide. The tungsten carbide support comprises a chromium binder phase including 6 to 15% of carbide. The relative proportions by weight of nickel and chromium of the binder phase vary from 60 to 90% to 40 to 100%, respectively. The abrasive is made by placing a layer of diamond grains into a cupel, covering this layer with a tungsten carbide layer including a nickel-chromium mixture to provide the support, subjecting the stack thus produced to a temperature and a pressure sufficient to cause sintering in the plastic phase of the diamond grains and to assure the binding of the compact thus obtained on the support. Drilling and machine tools can be equipped with the abrasive product of the invention.

13 Claims, No Drawings

COMPOSITE DIAMOND ABRASIVE, PROCESS FOR PREPARATION, AND DRILLING OR MACHINING WHICH ARE EQUIPPED WITH IT

FIELD OF THE INVENTION

This invention relates to a composite diamond abrasive, its preparation process and the drilling or machining tools which are equipped with it.

This invention relates more particularly to composite abrasives of the type having a part consisting of a "compact" containing diamond grains representing more than 80% by volume of the compact, each grain being bonded directly to its neighbors to exhibit a polycrystalline structure made solid with a hard refractory support consisting essentially of a refractory carbide such as tungsten carbide.

BACKGROUND OF THE INVENTION

The term "compact" designates a sintered product consisting of grains bonded to each other by bridges created by diffusion of matter in the plastic state, also called bridging. This sintering in the plastic state is obtained at pressures and temperatures on the order of the size of pressures and temperatures used for the synthesis of diamond grains.

The term "compact" does not cover abrasives comprising a support of silicon carbide and polycrystalline diamond, nonsintered because it is not subjected during production to temperatures and pressures that are sufficient to make possible the intergrowth of diamond grains; in these products, the gaps between grains of the composite are occupied by a compound of silicon and a metal such as nickel, as shown in U.S. Pat. No. 4,241,135. These products exhibit a poor resistance to abrasion because of the absence of sintering.

Nor does the term "compact" include composite abrasives as shown in U.S. Pat. No. 4,124,401, comprising a polycrystalline diamond compound cemented by a binder containing silicon associated with a carbide support whose cohesion is provided by cobalt. The absence of a catalyst and of sintering during the production of the diamond compound prevents the formation of direct bridges between the diamond grains. A sintered compact having a highly rigid skeleton is not obtained, but rather a product that can be qualified as being cemented by a binder. Such a product is sometimes called "cemented," according to terminology derived from English.

In some compacts of the type defined above, as shown in U.S. Pat. No. 3,239,921, obtained at a temperature able to exceed 1,750°, the gaps in the compact are occupied by a conversion catalyst such as Co, Va, Ti, Zr, Cr, Si. These products have the drawback of rapidly degrading (poor resistance to abrasion) because the sintering is performed in the absence of a sufficient quantity of diamond grains.

Products are known in which a compact is directly bonded to a metal carbide support (generally tungsten carbide). French patent 2,089,415 describes such a composite product consisting of a diamond compact on a tungsten carbide support; the compact and the carbide contain the same additive which can be cobalt, nickel or iron, this additive assuming, on the one hand, the role of diamond solvent-catalyst and, on the other hand, the role of binder for carbide sintering. These products exhibit the drawback of rapidly degrading when the active part is brought to a temperature exceeding about 700° because, on the one hand, of stresses induced in the metal matrix as a result of thermal expansion of this matrix and, on the other hand, because of the tendency of the diamond in contact with the catalyst to revert to the graphite state when it is brought to a high temperature without simultaneously being subjected to a high pressure. This graphitization affects the structural integrity of the composite.

Such a product with a cobalt binder is available on the market and currently used thus cannot be used for work which brings it to temperatures higher than 750°.

The use of a nickel binder would provide a partial solution to these problems, but the mechanical properties of tungsten carbide comprising such an additive are very inferior to those of tungsten carbide with cobalt binder, which explains why these products up to now have not had industrial applications.

Diamond abrasives were recently proposed in Japanese 164073 and European 0 198 653 that are not associated with a tungsten carbide support and are produced by direct sintering of diamond grains in the presence of binder containing nickel, for example nickel alloyed with chromium.

These products exhibit the drawback of not being able to be brazed on tools, which very seriously limits their applications and thus their use.

Therefore, no composite abrasive, i.e., consisting of a compact and a support solid with it, exists that provides simultaneously the qualities of thermostability and resistance to abrasion desired for current abrasives.

SUMMARY OF THE INVENTION

The invention thus has the object of proposing a diamond abrasive on a support that can be brazed that meets better than those previously known practical requirements, in particular in that it contains a compact in which the diamond grains are directly bonded to each other by bridges, thus exhibiting increased thermostability.

It has been determined that using a nickel-chromium binder as binder for sintering of a tungsten carbide support makes it possible to obtain a composite diamond abrasive exhibiting, compared with a similar product with a tungsten carbide support with cobalt binder, an equivalent resistance to abrasion, increased thermostability and better resistance to corrosion of the carbide support. The product is, further, provided with nonmagnetic properties.

The composite diamond abrasive according to the invention, the active part of which consists of a sintered product containing diamond grains, each grain being bonded directly to its neighbors by bridging to exhibit a polycrystalline structure, associated with a support consisting essentially of tungsten carbide, is characterized in that the tungsten carbide support contains a nickel-chromium binding phase.

The active part contains at least 80% by volume of diamond.

According to one preferred embodiment of the invention, the catalyst binder of the diamond is a nickel-chromium binder coming from the binder phase of the support.

The binder phase of the support represent's from 6 to 15% and preferably 10% by volume of the carbide.

The relative proportions by weight of nickel and chromium in the binder phase vary over a range of 60 to 90% for nickel and 40 to 10% for chromium.

Beyond the advantages mentioned above, the new binder phase of the tungsten carbide support exhibits the advantage of avoiding the oxidation problems that can appear at the interface of the support/active part during diffusion of the binder in the diamond.

DETAILED DESCRIPTION OF THE INVENTION

The production process of the diamond abrasive according to the invention will now be described in detail.

In a cupel of refractory protective metal (preferably of molybdenum) is placed the powder intended to constitute the active layer of the product; involved is a mixture of diamond grains whose grain size is selected as a function of the application envisioned, this grain size being generally greater for drilling products than for machining products.

Thus, for products intended for machining, a diamond powder whose average grain size is between 0.5 and 30 microns can be used: for products intended for drilling, an average grain size of 20 to 150 microns is preferred.

Then there is placed, on the layer thus formed, a piece of tungsten carbide that is already sintered and contains, as sintering binder, a nickel-chromium binder. This piece, called a slug, generally has a cylindrical shape. Its face in contact with the diamond mixture can be plane, hemispherical or grooved. The shape of this interface depends on the use of the composite.

The cupel is crimped on the carbide slug to provide good sealing and to avoid any contamination of the active part.

According to another embodiment of the invention are placed, on the diamond powder layer, the pulverulent components of the support, i.e., a tungsten carbide powder with 6 to 15% of a nickel-chromium mixture added, the relative proportions of the nickel and the chromium varying in a range of 60 to 90% and from 40 to 10%.

The assembly thus obtained is then surrounded by a pressure-transmitting material that can be selected from sodium chloride, hexagonal boron nitride, talc or any other suitable material.

The unit is placed in a metal or graphite resistor. The entire object is surrounded by a pressure-transmitting material able to form sealing joints, such as pyrophyllite.

This "cell" is then introduced into a press which can develop ultrahigh pressures and high temperatures.

The U.S. Pat. No. 3,913,280 describes a press of this type.

First of all, pressure to reach the thermodynamic stability zone of diamond, then resistance heating are applied.

The operating conditions are between 40 and 60 kbars and 1,250° and 1,550° for two to fifteen minutes; it is preferred to work at 55 kbars and 1,400° for three minutes.

It is quite evident that the operating conditions can vary according to the type of press and the type of cell used to obtain good sintering. It is known by one skilled in the art that the optimal conditions for assuring the sintering of the active part must be determined experimentally.

Under the operating conditions described above and with the aid of the binder phase of the carbide support which diffuses, by capillary action, toward the layer of the ultrahard product, the diamond grains mutually bind together and form a network of intergranular bridges, the gaps between grains being filled by the binder phase.

After sintering under high pressure and temperature, the heating is stopped; it is allowed to cool to about 100°, then the pressure is removed. The compact is recovered after removal of the various materials that surround it. The metal cupel is sandblasted or attacked chemically with acid. The compact is then lapped and precision-ground. It can be cut into precise shapes by electroerosion or by laser.

In another embodiment, between 5 and 10% by volume of nickel-chromium mixture is added to the diamond grains of the active part.

In yet another embodiment, a nickel-chromium alloy layer is placed in contact with the diamond grains; this layer can be placed between the diamond powder and the support or on the upper part of the active part.

In still a further embodiment, between the active part and the support is placed an intermediate layer (diffusion barrier) consisting exclusively of diamond, tungsten carbide and/or nickel and chromium.

The characteristics of the product thus obtained have been determined by comparison with the only standard product available on the market, in which the binder of the tungsten carbide support is a cobalt binder.

The flank wear was studied as a function of the cutting speed both for the standard product and for the product according to the invention obtained under the conditions described in example 4 below.

The cutting conditions are the following:

| | |
|---|---|
| a (depth of pass) = | 0.5 mm |
| f (advance) = | 0.7 mm/tr |
| amount machined = | 100 $cm^3$/pass |
| material machined = | dry granite |

The examination of the results makes it possible to distinguish three distinct zones:

the first zone (100 to 200 m/min) represents the wear of the tool due essentially to degradation by abrasion. The diamond grains are torn away from the tool one after the other. The wear measures this tendency toward "stripping," therefore the quality of the bridging of the diamond grains in the active part of the tool. The energy necessary for cutting acts essentially to remove material and wear the tool. In this case, the standard product and the product according to the invention have an equivalent resistance to abrasion at low speed (equivalent wear);

the second zone (200 to 250 m/min) is an intermediate zone between the first and last zone described below;

the third zone (higher than 250 m/min) represents the wear of the tool due essentially to thermal degradation. The energy necessary for cutting that acts to remove matter and wear the tool (as in the first zone) also acts to heat the tool. Actually, the tool heats up a great deal during work at these elevated speeds and the stresses due to this increase in temperature are preponderant; if the tool is not thermostable, a thermochemical degradation is added to the wear by abrasion; the expansion of the binder of the diamond part tends to make the intergranular bridges of the diamond fragile and thus promotes wear. In this case, the product according to the invention exhibits clearly less wear than the standard product and this indicates better temperature behavior of the product of the invention (increased thermostability). Actually, thermochemical degradation is nonexistent. All the cutting energy is transformed into removal of matter and into heat, which reduces the role of degradation of the abrasive type.

The product according to the invention, unlike the standard product, can thus be used for dry cutting.

This characteristic is also very useful in the case of drilling tools: poor cooling of the drill head is no longer a problem with the product according to the invention. This characteristic also makes possible the brazing of tools according to a less stressful operating process.

In addition, thermal damage tests of the product according to the invention have been performed and it has been able to be established that this product retains its wear characteristics after heating to 850 ° while, under the same conditions, the standard product no longer cuts.

Impact-resistance tests have shown, in addition, that the product according to the invention gives results that are equivalent or slightly superior to those of the standard product.

In conclusion, it can thus be said that compared with the standard product, the product according to the invention exhibits the following characteristics:

equivalent abrasion resistance
improved impact resistance
increased thermostability
nonmagnetic qualities
increased resistance of the support to corrosion.

The resistance to corrosion and the nonmagnetic characteristics of the nickel-chromium make possible applications (press anvils) using induction heating, for example, that the standard product does not offer.

The invention also relates to tools equipped with the composite diamond abrasive described above and, more specifically, tools intended for cutting as well as drilling.

The following examples illustrate the invention without, however, limiting it.

EXAMPLE 1

In a molybdenum cupel, there are placed in successive layers:

a mixture constituting the active layer comprising 87% by weight of diamond grains having a maximum semilogarithmic grain-size distribution of 20 microns and 13% by weight of solvent-catalyst consisting of nickel and chromium powder with grain size equivalent to that of the diamond in a mass ratio of 80/20;

a mixture constituting the diffusion barrier comprising 50% by volume of sintered tungsten carbide powder to 8% by weight of nickel with 200/325 mesh (45 to 80 microns) grain size and 50% by volume of diamond grains with 20-micron grain size mixed with 13% by weight of nickel and chromium in a mass ratio of 40/60;

a sintered tungsten carbide disk with 10% by weight of binder phase consisting of nickel and chromium in a mass ratio of 80/20.

The powder quantities used are such that the thicknesses in the final sintered product are 0.7 mm for the active layer and 9.2 mm for the diffusion barrier. The tungsten carbide support is 0.9 mm in thickness.

The cupel is crimped on the carbide slug, then the unit is placed in a cell. The cell is subjected to a pressure of about 60 kbar and a temperature of 1,500° for three minutes. After cooling, the pressure is removed. The composite product recovered then has its cupel removed by chemical attack and is then lapped on the two faces. Shapes were then cut by electroerosion from this piece, then mounted by brazing on a cutting tool support. After grinding and polishing, the tools thus obtained were used for dry cutting of tungsten deposit on cathodes for X-ray tubes. The results relating to the life of the abrasive were two to three times superior to those obtained with conventional tools with cobalt binder.

EXAMPLE 2

In a molybdenum cupel there are placed in successive layers:

a mixture constituting the active layer with a composition identical with that of example 1 except for the maximum grain size, which is 8 microns;

a mixture constituting the diffusion barrier comprising 50% by volume of the sintered tungsten carbide powder and 8% by weight of nickel with a 325 mesh (80 microns) grain size and 50% by volume of diamond powder with 20 micron grain size mixed with I3% by weight of nickel and chromium in a mass ratio of 90/10;

a sintered tungsten carbide disk with 10% by weight of binder phase consisting of nickel and chromium in a mass ratio of 80/20 covered on its part in contact with the powder by a covering of 20 microns of chromium obtained by PVD (physical vapor deposition).

The thicknesses of the various layers are identical with those in example 1.

The cupel is crimped on the slug, then the unit is placed in a cell. The latter is subjected to a pressure of about 60 kbar and a temperature of 1,500° for three minutes. After cooling, the pressure is removed. The composite product is treated in a way identical with that of example 1. The cutting tools produced were used for cutting high-density wood panels. The performances obtained were 10% superior to those of a piece with cobalt binder.

EXAMPLE 3

In a molybdenum cupel there are placed in successive layers:

the powder constituting the active layer comprising 100% diamond grains with grain size between 20 and 60 microns, the mixture constituting the diffusion barrier comprising 50% by volume of 325 mesh (80 microns) electrocast tungsten carbide powder and 50% by volume of diamond powder with 60 micron grain size;

a sintered tungsten carbide cylinder with 11% by weight of binder phase consisting of nickel and chromium in a mass ratio of 85/15.

The amounts of powder used are such that the thicknesses in the final sintered product are 0.7 mm for the active layer and 0.15 mm for the diffusion barrier. The tungsten carbide support is 7.4 mm in thickness.

After crimping the cupel on the carbide slug, the unit is placed in a cell that is subjected, after having reached a pressure of 55 kbar, to a temperature of 1,400° for 3.5 minutes. After cooling, the pressure is removed. The composite product (sliver) then has its cupel removed by sandblasting. It is then lapped on the two faces, then precision-ground to standard diameter. The product was then brazed on a head of a drilling tool. The slivers placed on the periphery of the head, the zone most stressed by temperature, were notably less worn than those of the standard product with a cobalt binder.

EXAMPLE 4

In a molybdenum cupel are placed the following in successive layers:

the powder constituting the active layer comprising 100% of diamond grains with grain size between 20 and 60 microns in a sufficient quantity to form a 0.7 mm sintered layer;

a sintered tungsten carbide cylinder with 11% by weight of binder phase consisting of nickel and chromium in a mass ratio of 85/15.

The thickness of this support is 3.2 mm.

The production cycle was identical with that of the preceding example.

The slivers produced made it possible to make comparative tests with the standard product with cobalt binder.

EXAMPLE 5

In a molybdenum cupel with a hemispherical bottom there are placed the following successively, uniformly distributed in the half-sphere:

a layer constituting the active part comprising 87% by weight of diamond grains with grain size of 0.5 to 8 microns and 13% by weight of solvent-catalyst consisting of nickel and chromium powder with grain size equivalent to that of diamond in a mass ratio of 85/5;

a layer constituting 80% by volume of the preceding mixture and 20% by volume of sintered tungsten carbide with 8% nickel with 200/325 mesh (45 to 80 microns) grain size;

a layer consisting of the same components as the preceding but in which the volume ratios are 40/60 instead of 80/20;

a cylindrical slug that ends on one side in a half-sphere consisting of sintered tungsten carbide with 6% of Ni/Cr binder phase in a mass ratio of 85/15.

The amounts of powder used are such that the respective thicknesses of the layers in the final sintered product are 0.3 mm, 0.4 mm and 0.5 mm on a support with a total height of 16 mm.

After crimping the cupel on the carbide slug, the unit is placed in a cell that is subjected, after having reached a pressure of 55 kbar, to a temperature of 1,450° for four minutes. After cooling, the pressure is removed. The composite product thus produced (dome) then has its cupel removed by sandblasting. It is then precision-ground to the nominal diameter, then tapered into a cone on its rear face.

This product, because of its shape and its intermediate layers that act as a damping device, is particularly well suited to work involving impacts. It was mounted on a striking tool. The results were 1.2 times superior to the performances generally achieved with the product having a cobalt binder.

EXAMPLE 6

The product identical with the one obtained under the conditions of example 5 was used on the periphery of cones on tricone drilling heads. The results were equivalent to those of the product of the prior art with cobalt binder.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A composite diamond abrasive comprising an active phase comprising at least 80% by volume of a mass of sintered diamond grains, each of said grains being linked directly to its neighbors by bridging to exhibit a polycrystalline structure, and a support consisting essentially of tungsten carbide with a nickel-chromium binder phase, the relative proportions of nickel and chromium in said binder phase varying from 60 to 90% to 40 to 10%.

2. The composite according to claim 1 wherein said binder phase comprises 6 to 15% by volume of carbide.

3. The composite according to claim 3 wherein said binder phase comprises 10% by volume of carbide.

4. The composite according to claim 1 further including a catalyst binder comprising nickel-chromium coming from the binder phase of the support.

5. A method for producing a thermostable diamond abrasive comprising:

placing a layer of diamond grains into a cupel to form an active layer comprising at least 80% by volume of diamond;

covering said layer of diamond grains with a layer of a mixture of tungsten carbide and nickel-chromium wherein the relative proportions by weight of nickel and chromium are from 60 to 90% to 40 to 10%, respectively, has been inserted said tungsten carbide and nickel-chromium mixture forming a support for said diamond grains;

subjecting the layers to a temperature and pressure sufficient to sinter the diamond grains and bind the compact thus obtained onto the support.

6. The process according to claim 5 wherein the support layer is sintered tungsten carbide containing from 6 to 15% by volume of a nickel-chromium binder phase.

7. The process according to claim 5 wherein the support layer is a tungsten carbide powder containing from 6 to 15% of a pulverulent nickel-chromium mixture.

8. The process according to claim 5 wherein from 5 to 15% of a nickel-chromium mixture is added to the diamond grains.

9. The process according to claim 5 wherein a layer of nickel-chromium alloy is placed in contact with said diamond grains.

10. The process according to claim 5 wherein an intermediate layer consisting exclusively of diamond and tungsten carbide is placed between the active phase and the support.

11. The process according to claim 10 wherein the intermediate layer further includes a nickel-chromium mixture.

12. A composite diamond abrasive made by the method of claim 5 and comprising an active phase comprising sintered diamond grains, each of said grains being linked directly to its neighbors by bridging to exhibit a polycrystalline structure, and a support consisting essentially of tungsten carbide with a nickel-chromium binder phase.

13. A method of producing a composite diamond abrasive according to claim 1, comprising forming an active phase comprising sintered diamond grains, each of said grains being linked directly to its neighbors by bridging to exhibit a polycrystalline structure, and forming adjacent said active phase a support consisting essentially of tungsten carbide with a nickel-chromium binder phase.

* * * * *